US010227120B2

(12) United States Patent
Ajello

(10) Patent No.: US 10,227,120 B2
(45) Date of Patent: Mar. 12, 2019

(54) RETROFITTABLE WATERCRAFT PROPULSION DEVICE

(71) Applicant: Mike Ajello, Anaheim, CA (US)

(72) Inventor: Mike Ajello, Anaheim, CA (US)

( * ) Notice: Subject to any disclaimer, the term of this patent is extended or adjusted under 35 U.S.C. 154(b) by 0 days.

(21) Appl. No.: 15/894,351

(22) Filed: Feb. 12, 2018

(65) Prior Publication Data

US 2018/0162506 A1 Jun. 14, 2018

Related U.S. Application Data

(63) Continuation-in-part of application No. 15/649,573, filed on Jul. 13, 2017, now Pat. No. 10,017,233.

(60) Provisional application No. 62/361,834, filed on Jul. 13, 2016, provisional application No. 62/550,285, filed on Aug. 25, 2017.

(51) Int. Cl.

| | |
|---|---|
| ***B63H 5/07*** | (2006.01) |
| ***B63H 25/02*** | (2006.01) |
| ***B63H 21/22*** | (2006.01) |
| ***F02B 61/04*** | (2006.01) |
| ***B63B 35/79*** | (2006.01) |
| ***B63H 5/125*** | (2006.01) |
| ***B63H 5/14*** | (2006.01) |
| ***B63H 20/00*** | (2006.01) |

(52) U.S. Cl.

CPC ..... *B63H 5/07* (2013.01); *B63B 35/7943* (2013.01); *B63H 5/125* (2013.01); *B63H 5/14* (2013.01); *B63H 20/007* (2013.01); *B63H 21/22* (2013.01); *B63H 25/02* (2013.01); *F02B 61/04* (2013.01)

(58) Field of Classification Search

CPC ..... B63H 16/00; B63H 16/04; B63H 5/07; B63H 25/02; B63H 21/22; F02B 61/04

USPC ..... 440/6, 101; 416/74

See application file for complete search history.

(56) References Cited

U.S. PATENT DOCUMENTS

| | | | | |
|---|---|---|---|---|
| 8,512,086 | B1 * | 8/2013 | Charczuk | B63H 20/007 440/6 |
| 10,017,233 | B2 * | 7/2018 | Ajello | B63H 16/04 |

* cited by examiner

*Primary Examiner* — Lars A Olson

(57) ABSTRACT

A retrofittable watercraft propulsion device enables motorized propulsion and maneuvering of a watercraft occupied by a user. The retrofittable watercraft propulsion device includes an elongated shaft, an impeller pump, a handle, a control input device, a portable power source, a swivel bracket, and a microprocessor. The elongated shaft submerges the impeller pump below the waterline and provides support for the user while the watercraft is in motion. The impeller pump harnesses the water and generates thrust to propel and maneuver the watercraft. The control input device allows the user to throttle or brake the impeller pump. The portable power source supplies electrical energy to the microprocessor and the impeller pump. The swivel bracket swivels the elongated shaft and redirects the thrust of the impeller pump. Finally, the microprocessor controls the impeller pump based on how the user operates the control input device.

17 Claims, 11 Drawing Sheets

RETROFITTABLE WATERCRAFT PROPULSION DEVICE

The current application is a continuation-in-part (CIP) application of a U.S. non-provisional application Ser. No. 15/649,573 filed on Jul. 13, 2017. The U.S. non-provisional application 15/649,573 claims a priority to a U.S. provisional application Ser. No. 62/361,834 filed on Jul. 13, 2016.

The current application also claims a priority to a U.S. provisional application Ser. No. 62/550,285 filed on Aug. 25, 2017.

FIELD OF THE INVENTION

The present invention generally relates to retrofittable watercraft propulsion device. More specifically, an impeller pump mounted terminally to an elongated shaft generates directional thrust for propelling and maneuvering a watercraft occupied by a user.

BACKGROUND OF THE INVENTION

Many water sport enthusiasts are people who utilize a variety of tools to cruise along the water. Kayaks, paddleboards, rafts, canoes, surfboards, and more enable users to float atop the surface of oceans, lakes, rivers, streams, and similar large bodies of water. By choosing the correct watercraft, the user can determine the amount of physical effort the user would like to apply to the watercraft, thus determining the level of exercise the user would like to experience. The user may utilize paddles to row a watercraft faster or may utilize paddles in conjunction with currents and waves to propel the watercraft in a desirable direction.

However, due to the required use of traditional paddles to propel the watercraft in a specific direction, such water activities are limited in range and practicality. While useful for fitness purposes, as a kayak, paddleboard, or other watercraft user gets tired, it becomes more difficult to move at high speeds through the water. Paddling is therefore not ideal for users interested in simply enjoying being in the water or moving at high speeds through the water. Further, utilizing a paddle on a paddleboard requires the user to both pull against the paddle arm and shift the user's weight forward, in order to remain balanced. This limits the speed at which a user can travel. A water sport enthusiast must remain relatively close to land to ensure that, in the event of an emergency, such as sudden storms, the user is not in danger of being subject to dangerous large waves or increased water turbulence. What is needed is an improved means of providing propulsion forces to navigate manually-powered watercraft through water. What is further needed is a device that can vary in mounting width to enable use with a variety of watercraft.

The present invention addresses these issues. The present invention has a motorized propeller mounted to a rod that extends into the water. The user controls the speed of the propeller through the use of hand controls on the rod. The user may also control the direction of propulsion by turning the rod, thereby adjusting the swivel bracket that connects the propeller rod to the watercraft. A mounting outrigger bracket secures across the top of kayaks, paddleboards, and more, providing optimal leverage for supporting the propeller rod. The propeller rod contains its own battery pack within the rod apparatus. The present invention further provides an alternative propeller powering means in the form of an electrical power unit that can be mounted to the watercraft, providing long-term power security.

DETAILED DESCRIPTION OF THE INVENTION

All illustrations of the drawings are for the purpose of describing selected versions of the present invention and are not intended to limit the scope of the present invention.

Figure 1:
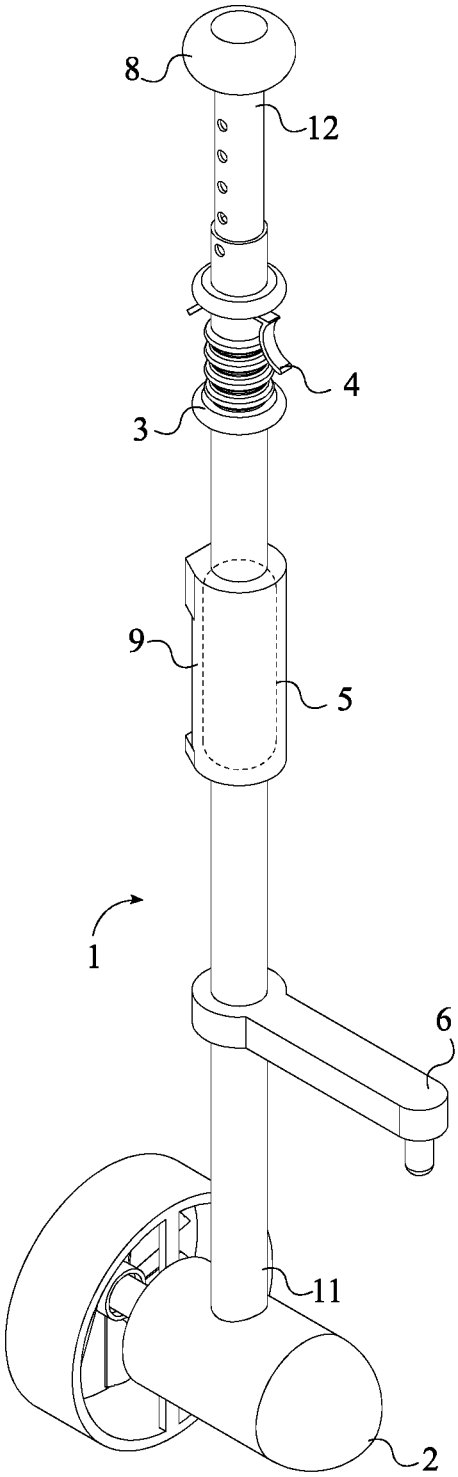
FIG. 1 is a front perspective view of the present invention.

Referring to FIG. 1, the present invention is a retrofittable watercraft propulsion device enabling motorized propulsion of a watercraft. The preferred embodiment of the present invention comprises an elongated shaft 1, an impeller pump 2, a handle 3, a control input device 4, a portable power source 5, a swivel bracket 6, and a microprocessor 7. The preferred elongated shaft 1 is a poly-carbonate tube that forms a watertight seal around the portable power source 5 and prevents water from contacting the portable power source 5 and the other electrical components. Further, the elongated shaft 1 also positions the impeller pump 2 below the water line. This allows the impeller pump 2 to generate the thrust used to propel and maneuver the watercraft. The control input device 4 throttles the impeller pump 2 and adjusts the thrust being generated. More specifically, the control input device 4 communicates with the microprocessor 7 that interprets signals from the control input device 4 and controls the impeller pump 2, accordingly. To change the direction of the thrust, the elongated shaft 1 is mounted onto a swivel bracket 6. The swivel bracket 6 physically swivels the impeller pump 2 to change the direction of the thrust.

Figure 2:
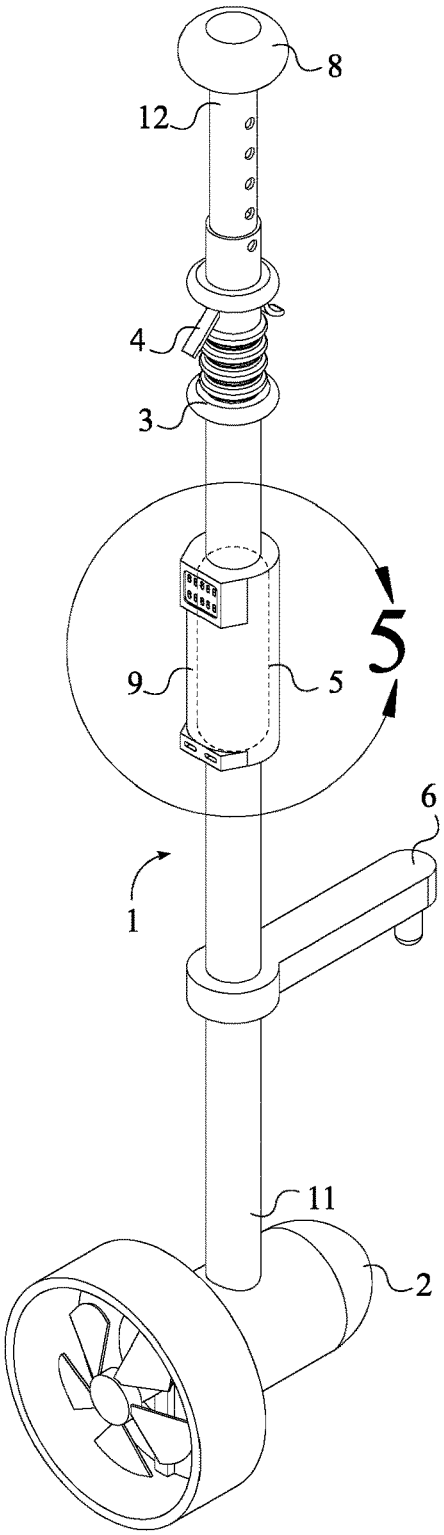
FIG. 2 is a rear perspective view of the present invention.
Figure 3:
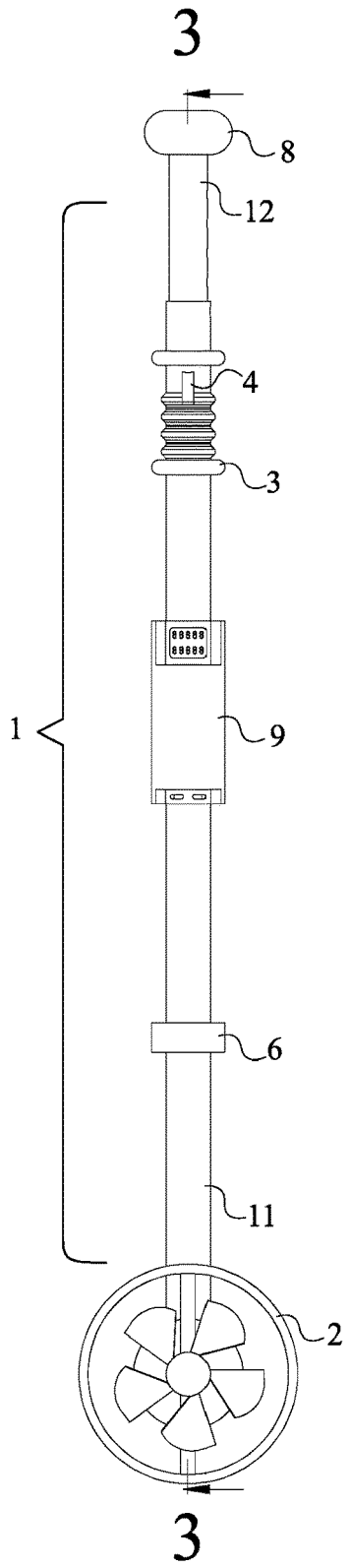
FIG. 3 is a rear view of the present invention.
Figure 4:
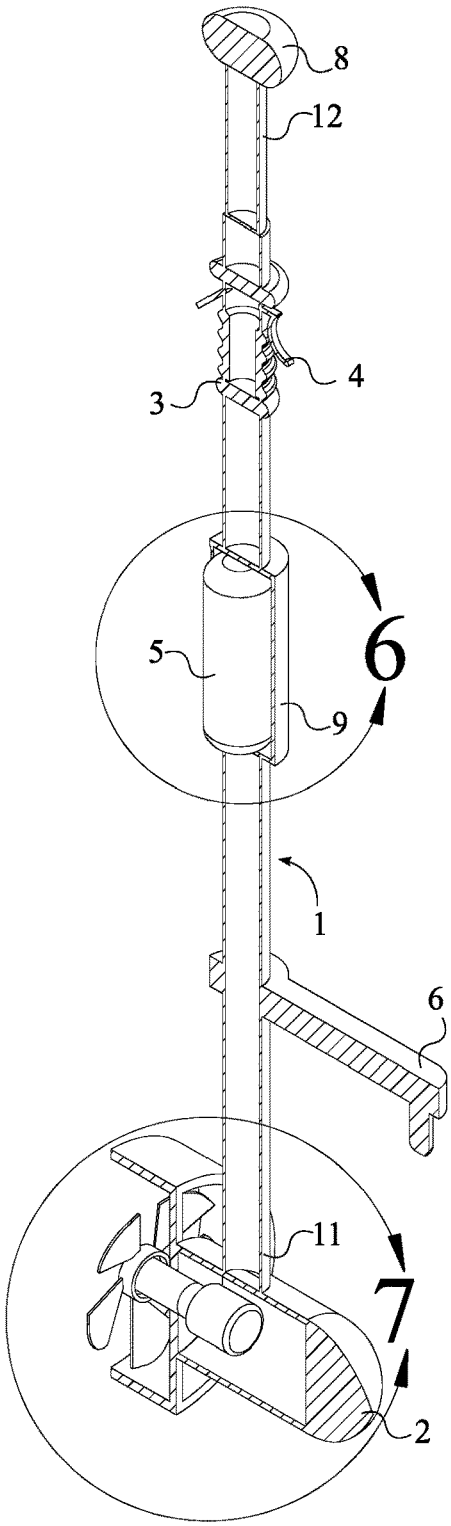
FIG. 4 is a cross section view taken along line 4-4 in FIG. 3.
Figure 10:
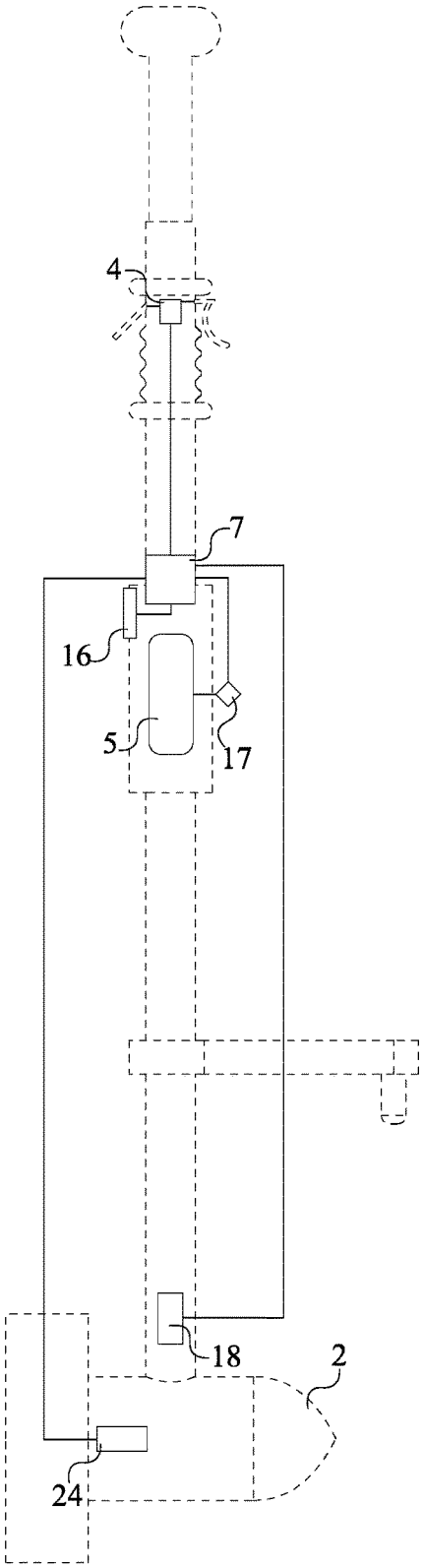
FIG. 10 is a schematic diagram showing the electronic connections of the present invention.

Referring to FIG. 2 and FIG. 10, the elongated shaft 1 comprises a first shaft end 11 and a second shaft end 12. Preferably, the first shaft end 11 corresponds to the portion of the elongated shaft 1 that is submerged below the waterline. As such, the impeller pump 2 is connected adjacent to the first shaft end 11, which positions the impeller pump 2 below the waterline. In contrast, the second shaft end 12 is near the portion of the elongated shaft 1 that the user grips. As such, the handle 3 is integrated into the elongated shaft 1, offset from the second shaft end 12. When the watercraft is in motion, the user may hold on to the elongated shaft 1 for support. Letting go of the handle 3 may cause the user to lose balance and fall. Thus, the control input device 4 is laterally mounted onto the handle 3, thereby eliminating any reason to release the handle 3. Further, the control input device 4 is electronically connected to the microprocessor 7. The microprocessor 7 is preferably an integrated circuit programmed to take inputs from the control input device 4 and output signals that can be interpreted by the impeller pump 2. More specifically, the microprocessor 7 sends output signals to an electric speed control that is responsible for regulating the speed of the impeller pump 2. The electric speed control interprets the signals transmitted by the microprocessor 7 and changes the speed of the motor 24. The microprocessor 7 and the portable power source 5 are both housed within the elongated shaft 1. This prevents moisture from interfering with the transmission of signals to and from the microprocessor 7. Preferably, the portable power source 5 is a lithium-ion battery that powers all of the electrical components.

Figure 11:
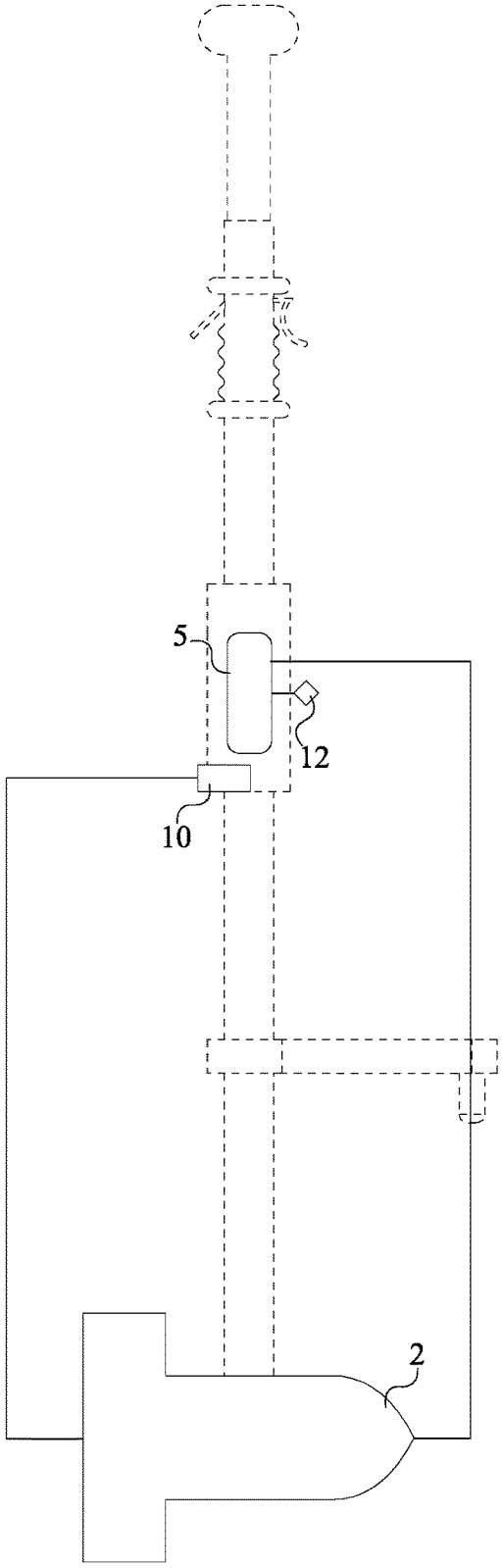
FIG. 11 is a schematic diagram showing the electrical connections of the present invention.

Referring to FIG. 11, the portable power source 5 is electrically connected to the impeller pump 2. More specifically, the portable power source 5 and the impeller pump 2 are connected by internal wiring that traverses through the elongated shaft 1. The swivel bracket 6 is integrated into the elongated shaft 1, offset from the impeller pump 2. The preferred swivel bracket 6 is a flat plate mounted perpendicular to the elongated shaft 1. A cylindrical extrusion is mounted on the plate opposite the elongated shaft 1. The cylindrical extrusion inserts into a hole in the outrigger bracket that mounts onto the watercraft. In addition, a rotation axis of the impeller pump 2 is positioned perpendicular to a longitudinal axis of the elongated shaft 1. As a result, the thrust generated by the impeller pump 2 is oriented parallel to the watercraft. This allows the watercraft to maneuver forward, backwards, and side-to-side. The present invention may further comprise a grip 8 that provides a second holding point for the user. The grip 8 is connected adjacent to the second shaft end 12.

Figure 7:
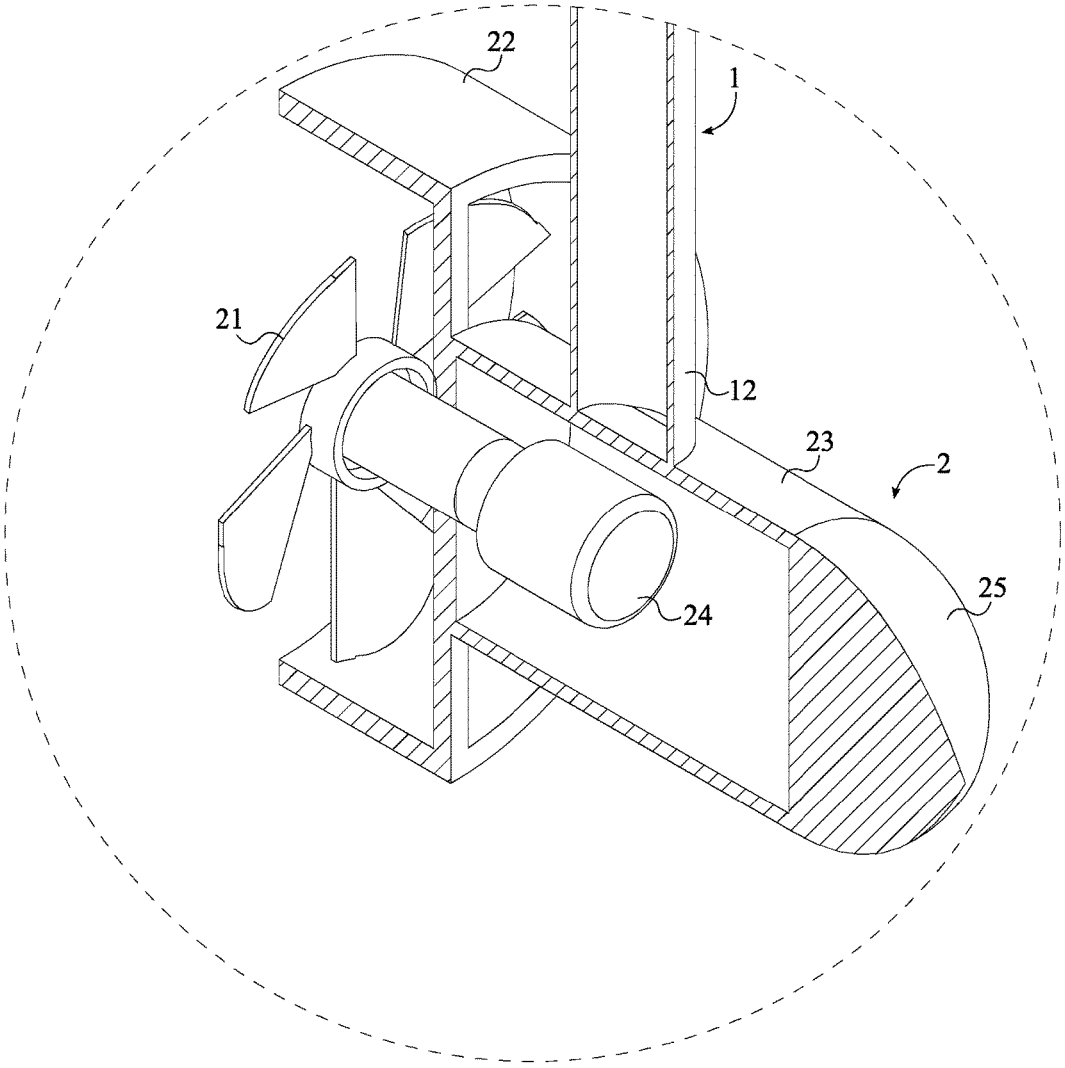
FIG. 7 is a detail view taken about circle 7 in FIG. 4 illustrating the subcomponents of the impeller pump.

Referring to FIG. 7 and FIG. 10, the impeller pump 2 comprises an impeller 21, an annular guard 22, a main body 23, a motor 24, and a hydrodynamic fairing 25. By actuating the control input device 4, the user can control the speed of the motor 24. More specifically, the control input device 4 generates inputs for the microprocessor 7 which is electronically connected to the motor 24. The microprocessor 7, in turn, interprets the inputs and controls the motor 24, accordingly. In the preferred embodiment of the present invention, the motor 24 is an electric motor housed within the main body 23. The preferred embodiment of the impeller 21 comprises a plurality of blades mounted onto a central hub. The impeller 21 is torsionally connected to a rotor of the motor 24. More specifically, the central hub is torsionally connected to an output shaft of the motor 24. This radially distributes the plurality of blades about the rotation axis. Thus, when the impeller 21 starts spinning, water accelerates past the impeller 21 generating thrust in the opposite direction. In the preferred embodiment, the impeller 21 is positioned adjacent to the main body 23. More specifically the impeller 21 is mounted to the back of the main body 23. This longitudinally aligns the main body 23 with the rotation axis of the impeller pump 2. Since the impeller 21 can cause serious injury if it contacts human flesh, the annular guard 22 is mounted adjacent to the main body 23. Accordingly, the impeller 21 is encircled by the annular guard 22. Finally, the hydrodynamic fairing 25 is connected adjacent to the main body 23, opposite the impeller 21. The hydrodynamic fairing 25 is a cone shaped fairing mounted to the front of the main body 23. The hydrodynamic fairing 25 guides the water flow around the main body 23 and into the impeller 21, thereby reducing the overall drag of the main body 23 and increasing efficiency.

Figure 9:
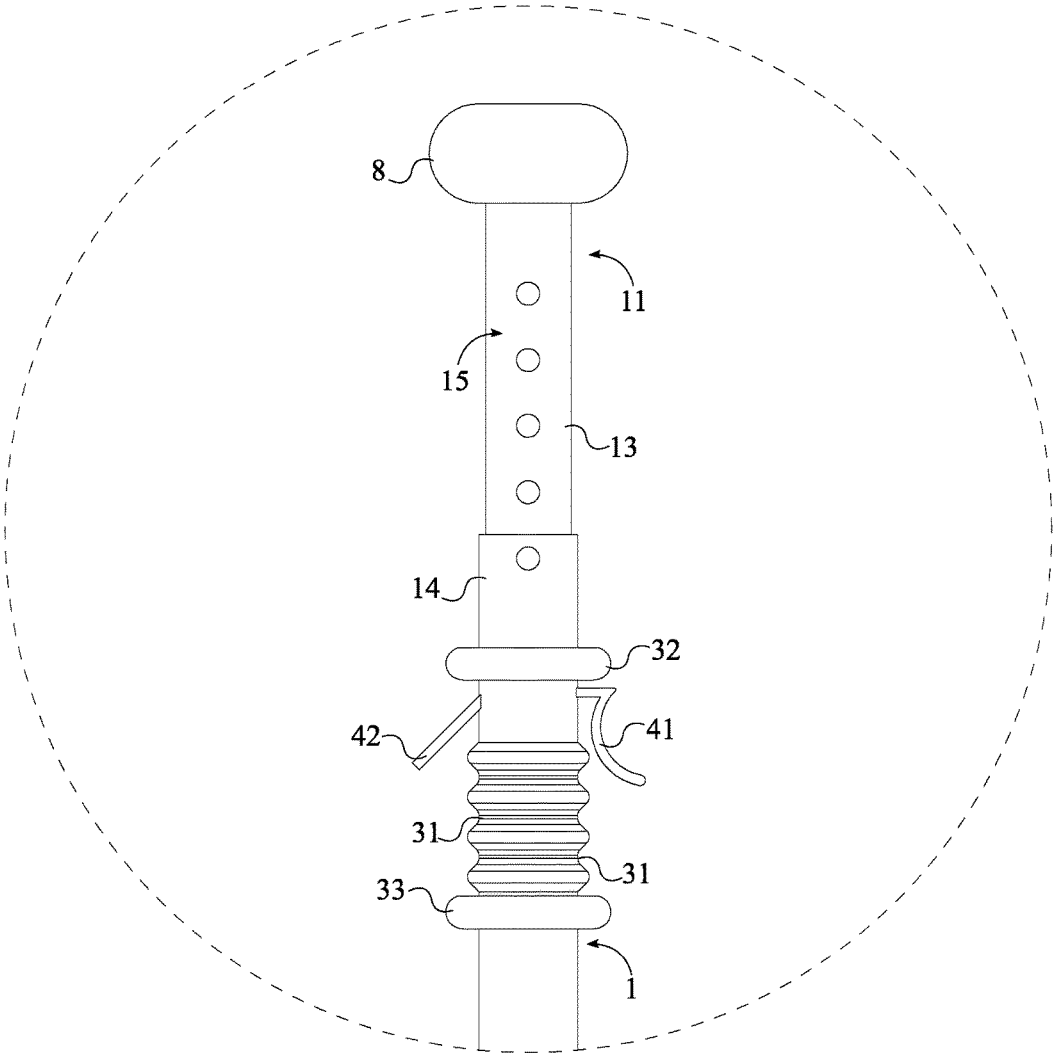
FIG. 9 is a detail view taken about circle 9 in FIG. 8 illustrating the handle, the first telescoping tube, the second telescoping tube, and the control input device.

Referring to FIG. 9, the handle 3 comprises a plurality of finger grooves 31 that enables the user to securely grip the handle 3 for support. Further, the control input device 4 comprises a variable speed trigger 41 and a safety stop 42. In the preferred implementation, each of the plurality of finger grooves 31 is serially positioned along the length of the elongated shaft 1. As a result, the user's fingers naturally contact the plurality of finger grooves 31 when the user grips the handle 3. The variable speed trigger 41 is mounted adjacent to the plurality of finger grooves 31. This positions the variable speed trigger 41 below the user's index finger, thereby eliminating the need to release the handle 3 to actuate the variable speed trigger 41. The preferred variable speed trigger 41 uses a potentiometer that allows incremental throttling of the thrust generated by the impeller pump 2. Thus, the user can gradually increase or decrease the speed of the watercraft. In contrast, actuating the safety stop 42 abruptly cuts off all of the power being supplied to the impeller pump 2. As such, the safety stop 42 is used as a braking mechanism used for an emergency stop. In the preferred embodiment, the safety stop 42 is mounted adjacent to the plurality of finger grooves 31, opposite the variable speed trigger 41. More specifically, the safety stop 42 is positioned below the user's thumb to allow the user to quickly switch from throttling to braking the impeller pump 2.

To help the user grip onto the elongated shaft 1, the handle 3 further comprises a first flange 32 and a second flange 33. The first flange 32 and the second flange 33 are laterally connected along the elongated shaft 1. More specifically, the first flange 32 is positioned facing the first shaft end 11 of the elongated shaft 1, whereas the second flange 33 is positioned facing the second shaft end 12 of the elongated shaft 1. Further, the first flange 32 and the second flange 33 are positioned opposite to each other across the plurality of finger grooves 31. As a result, the first flange 32 and the second flange 33 protrude out of the lateral surface of the elongated shaft 1 and form barriers that brace the user's hands. This prevents the user's hands from slipping along the elongated shaft 1. Further, the first flange 32 and the second flange 33 secure the user's hand near with the control input device 4. More specifically, the first flange 32 is positioned in between the plurality of finger grooves 31 and the second shaft end 12. Similarly, the variable speed trigger 41 and the safety stop 42 is positioned adjacent to the first flange 32. As such, the second flange 33 provides a barrier which prevents the user's hand from slipping, when the user releases the plurality of finger grooves 31 to press the variable speed trigger 41 or the safety stop 42.

Figure 5:
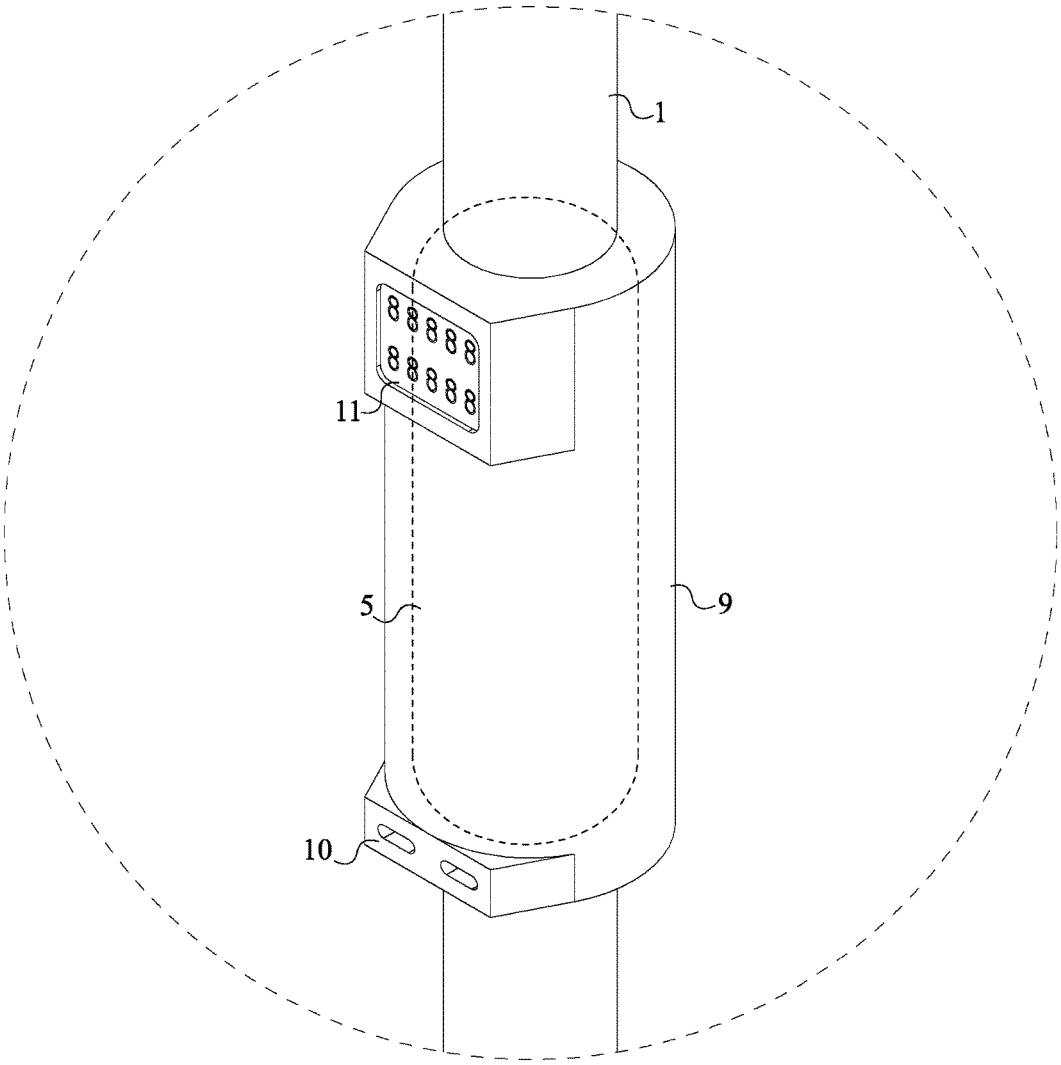
FIG. 5 is a detail view taken about circle 5 in FIG. 2 illustrating the battery chamber, the digital display, and the auxiliary power source.
Figure 6:
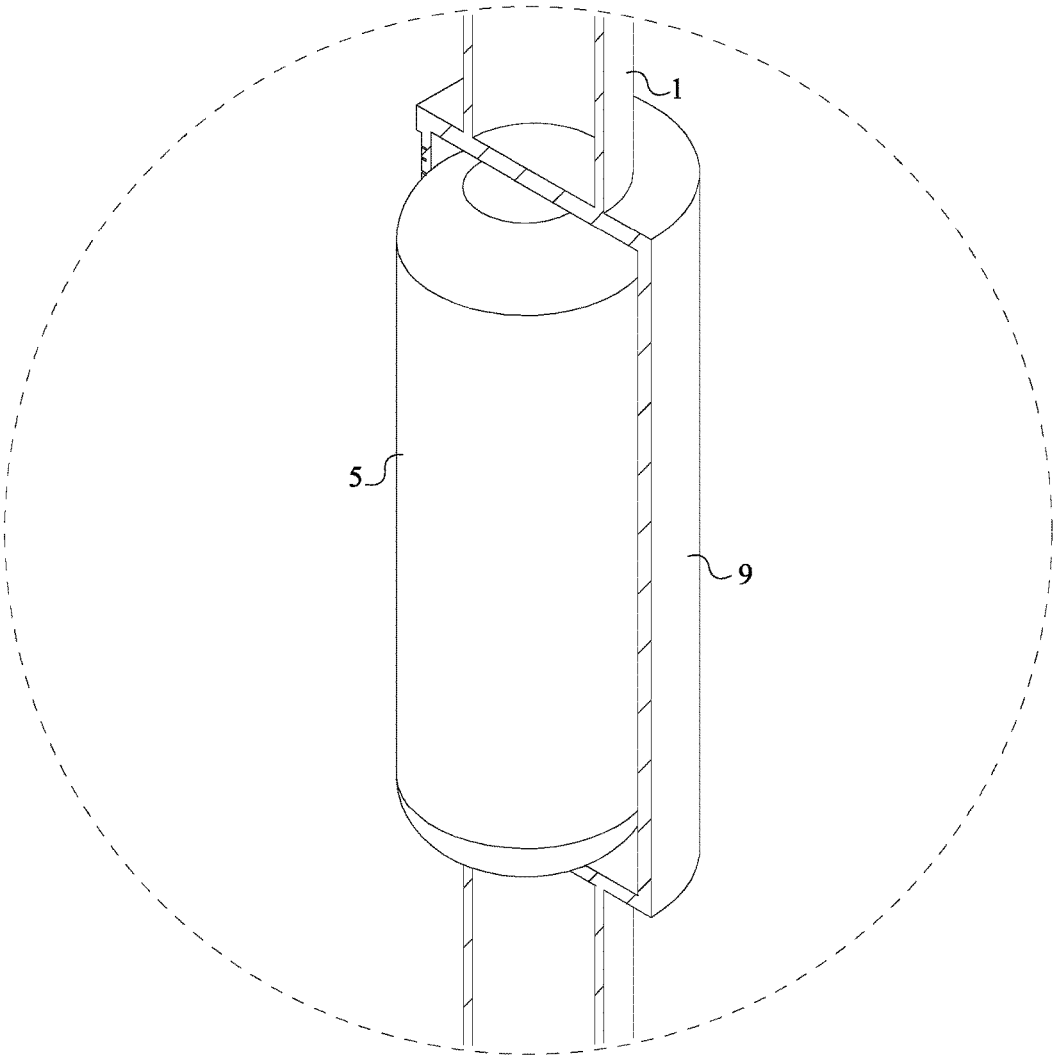
FIG. 6 is a detail view taken about circle 6 in FIG. 4 illustrating the portable power source mounted inside the battery chamber.

Referring to FIG. 5 and FIG. 6, a battery chamber 9 protects the portable power source 5 from environmental elements such as moisture that can damage the electrical circuitry of the portable power source 5. Preferably, the battery chamber 9 is integrated into the elongated shaft 1. Further, the portable power source 5 is mounted within the battery chamber 9. An access panel hingedly attached to the battery chamber 9 may allow the user to replace the portable power source 5 housed therein.

Referring to FIG. 5 and FIG. 11, an auxiliary power port 10 provides power to the impeller pump 2 independent of the portable power source 5. Accordingly, the auxiliary power port 10 is integrated into the battery chamber 9. In the preferred embodiment of the present invention, the auxiliary power port 10 is a socket allowing a power cord to connect an externally mounted battery pack to the impeller pump 2. The battery pack is watertight and mounted on the rear portion of the watercraft. Once the power cord is connected to the auxiliary power port 10, the auxiliary power port 10 is electrically connected to the impeller pump 2. This enables the impeller pump 2 to continue operating even when the portable power source 5 is completely depleted.

Referring to FIG. 5 and FIG. 10, a digital display 16 displays real-time power level of the portable power source 5 and speed of the watercraft. Power level readings are provided by a voltage sensor 17 that monitors the real-time energy capacity of the portable power source 5. A speed sensor 18 measures the speed of the watercraft in relation to the stationary ground. In the preferred embodiment, the digital display 16 is laterally mounted onto the elongated shaft 1. More specifically, the preferred digital display 16 is a liquid crystal display (LCD) panel mounted externally on top of the battery chamber 9. Similarly, the speed sensor 18 and the voltage sensor 17 is housed within the elongated shaft 1. For example, the speed sensor 18 may be a flow sensor submerged below the water line that measures the flow velocity of the water to determine the speed of the watercraft. Alternately, the speed sensor 18 may be a global positioning system (GPS) device, mounted above the waterline, that alternately measures the speed and the location of the watercraft. As such, the speed sensor 18 is electronically connected to the microprocessor 7.

Referring to FIG. 10 and FIG. 11, the portable power source 5 is electrically connected to the voltage sensor 17, and the voltage sensor 17 is electronically connected to the microprocessor 7. The microprocessor 7 processes the signals received from the voltage sensor 17 and determines the battery life and the time remaining until the portable power source 5 runs out of power. Similarly, the microprocessor 7 processes the signals from the speed sensor 18 and determines the speed of the watercraft in miles per hours (mph) or kilometer per hour (kph) in relation to the ground. The microprocessor 7 is also electronically connected to the digital display 16. This allows the microprocessor 7 to display the speed and the power level on the digital display 16. Alternately, the digital display 16 may be electronically connected to an electronic control module capable of reading the power level and determining the battery life and the remaining run time.

Figure 8:
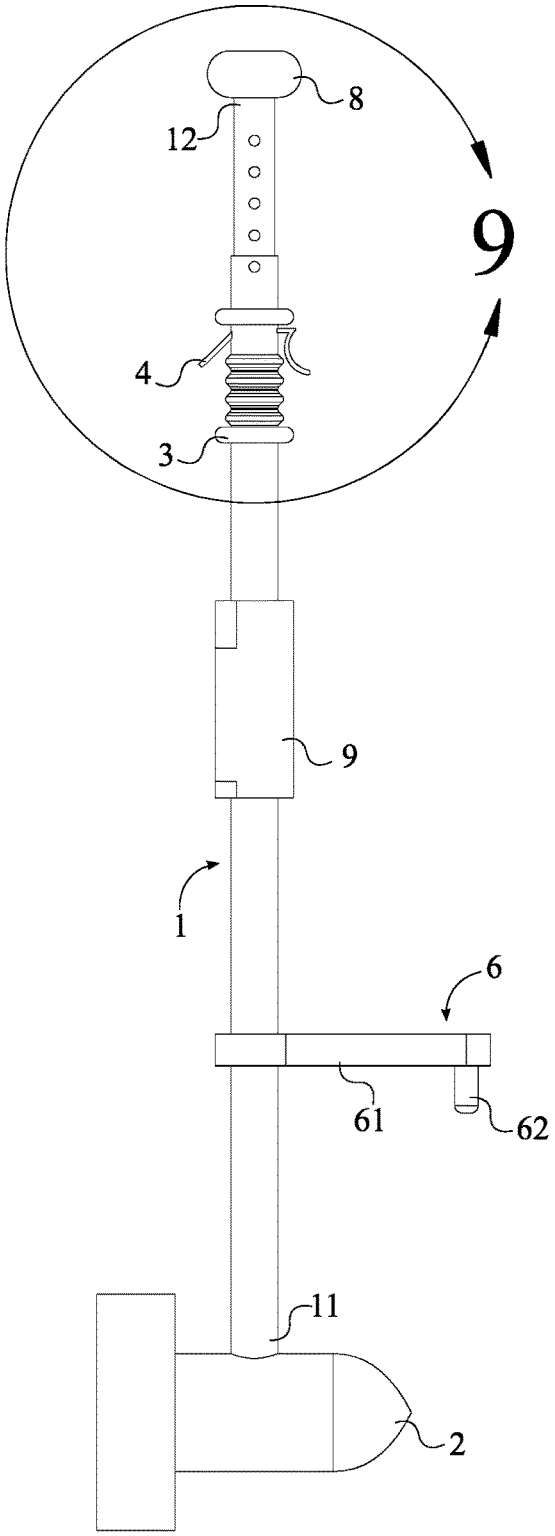
FIG. 8 is a side view of the present invention.

Referring back to FIG. 8, the swivel bracket 6 comprises an offsetting arm 61 and a connecting pin 62. The preferred embodiment of the present invention utilizes the outrigger bracket to fasten the elongated shaft 1 to the watercraft. More specifically, the outrigger bracket positions the elongated shaft 1 besides the watercraft. The offsetting arm 61 is mounted perpendicular to the elongated shaft 1 and is longitudinally aligned to the impeller pump 2. The offsetting arm 61 allows the user to point the impeller pump 2 to the front, side, or rear of the watercraft. This is done by physically rotating elongated shaft 1 about the connecting pin 62. The user can change the direction of the thrust generated by the impeller pump 2 by changing the direction of the offsetting arm 61. The connecting pin 62 pivotally connects the elongated shaft 1 to the outrigger bracket. As such, the connecting pin 62 is connected perpendicular to the offsetting arm 61. Further, the connecting pin 62 and the elongated shaft 1 is positioned opposite each other along the offsetting arm 61, so that the present invention allows for some workable clearance between the impeller pump 2 and the watercraft.

Referring back to FIG. 9, in the preferred embodiment of the present invention, the length of the elongated shaft 1 can be adjusted according to the height of the user. As such, the elongated shaft 1 further comprises a first telescoping tube 13, a second telescoping tube 14, and a locking mechanism 15. The grip 8 is terminally mounted on the first telescoping tube 13. Further, the first telescoping tube 13 is slidably engaged into the second telescoping tube 14, so that the user can raise or lower the grip 8 to a desired position. For example, a taller user may extend the first telescoping tube 13 out of the second telescoping tube 14 to position the grip 8 at a chest-level height, in easy reach of the user. Alternately, a shorter user may lower the first telescoping tube 13 into the second telescoping tube 14 to position the grip 8 in easy reach of the user. Once the first telescoping tube 13 is raised or lowered to the desired position, the locking mechanism 15 locks the length of the first telescoping tube 13. As such, the locking mechanism 15 is operatively integrated into the slidable engagement between the first telescoping tube 13 and the second telescoping tube 14, wherein the locking mechanism 15 is used to fix the first telescoping tube 13 and the second telescoping tube 14 at a variety of offsetting distances. More specifically, the preferred locking mechanism 15 comprises a plurality of slots that is drilled along the length of first telescoping tube 13. A positioning hole is drilled into a terminal portion of the second telescoping tube 14. To lock the height of the first telescoping tube 13, the positioning slot is aligned with a corresponding slot from the plurality of slots. A pin is then inserted through the positioning slot and the corresponding slot, thereby locking the position of the first telescoping tube 13. By choosing a corresponding slot located near the top or bottom of the first telescoping tube 13, the user can lower or raise the effective length of the first telescoping tube 13.

Although the invention has been explained in relation to its preferred embodiment, it is to be understood that many other possible modifications and variations can be made without departing from the spirit and scope of the invention as hereinafter claimed.

What is claimed is:

1. A retrofittable watercraft propulsion device comprises:

an elongated shaft;

an impeller pump;

a handle;

a control input device;

a portable power source;

a swivel bracket;

a microprocessor;

the elongated shaft comprises a first shaft end and a second shaft end;

the impeller pump being connected adjacent to the first shaft end;

the handle being integrated into the elongated shaft, offset from the second shaft end;

the control input device being laterally mounted onto the handle;

the control input device being electronically connected to the microprocessor;

the microprocessor being electronically connected to the impeller pump;

the microprocessor and the portable power source being housed within the elongated shaft;

the portable power source being electrically connected to the impeller pump;

the swivel bracket being integrated into the elongated shaft, offset from the impeller pump; and a rotation axis of the impeller pump being positioned perpendicular to a longitudinal axis of the elongated shaft.

2. The retrofittable watercraft propulsion device as claimed in claim 1 comprises:

a grip; and the grip being connected adjacent to the second shaft end.

3. The retrofittable watercraft propulsion device as claimed in claim 1 comprises:

the impeller pump comprises an impeller, an annular guard, a main body, a motor, and a hydrodynamic fairing;

the microprocessor being electronically connected to the motor;

the motor being housed within the main body;

the impeller being torsionally connected to a rotor of the motor;

the impeller being positioned adjacent to the main body;

the annular guard being mounted adjacent to the main body;

the impeller being encircled by the annular guard; and the hydrodynamic fairing being connected adjacent to the main body, opposite the impeller.

4. The retrofittable watercraft propulsion device as claimed in claim 1 comprises:

the handle comprises a plurality of finger grooves;

the control input device comprises a variable speed trigger and a safety stop;

each the plurality of finger grooves being serially positioned along the longitudinal axis of the elongated shaft;

the variable speed trigger being mounted adjacent to the plurality of finger grooves; and the safety stop being mounted adjacent to the plurality of finger grooves, opposite the variable speed trigger.

5. The retrofittable watercraft propulsion device as claimed in claim 1 comprises:

the handle further comprises a first flange and a second flange;

the first flange and the second flange being laterally connected around the elongated shaft;

the first flange and the second flange being positioned opposite to each other across the plurality of finger grooves;

the first flange being positioned in between the plurality of finger grooves and the second shaft end; and the variable speed trigger and the safety stop being positioned adjacent to the first flange.

6. The retrofittable watercraft propulsion device as claimed in claim 1 comprises:

a battery chamber;

the battery chamber being integrated into the elongated shaft; and the portable power source being mounted within the battery chamber.

7. The retrofittable watercraft propulsion device as claimed in claim 6 comprises:

an auxiliary power port;

the auxiliary power port being integrated into the battery chamber; and the auxiliary power port being electrically connected to the impeller pump.

8. The retrofittable watercraft propulsion device as claimed in claim 1 comprises:

a digital display;

a voltage sensor;

a speed sensor;

the digital display being laterally mounted onto the elongated shaft;

the speed sensor and the voltage sensor being housed within the elongated shaft;

the speed sensor being electronically connected to the microprocessor;

the portable power source being electrically connected to the voltage sensor;

the voltage sensor being electronically connected to the microprocessor; and the microprocessor being electronically connected to the digital display.

9. The retrofittable watercraft propulsion device as claimed in claim 1 comprises:

the swivel bracket comprises an offsetting arm and a connecting pin;

the offsetting arm being laterally connected to the elongated shaft, offset from the impeller pump;

the offsetting arm being positioned perpendicular to the elongated shaft;

the connecting pin being connected perpendicular to the offsetting arm; and the connecting pin and the elongated shaft being positioned opposite each other along the offsetting arm.

10. The retrofittable watercraft propulsion device as claimed in claim 1 comprises:

the elongated shaft further comprises a first telescoping tube, a second telescoping tube, and a locking mechanism;

the first telescoping tube being slidably engaged into the second telescoping tube; and the locking mechanism being operatively integrated into the slidable engagement between the first telescoping tube and the second telescoping tube, wherein the locking mechanism is used to fix the first telescoping tube and the second telescoping tube at a variety of offsetting distances.

11. A retrofittable watercraft propulsion device comprises:

an elongated shaft;

an impeller pump;

a handle;

a control input device;

a portable power source;

a swivel bracket;

a microprocessor;

the elongated shaft comprises a first shaft end and a second shaft end;

the impeller pump comprises an impeller, an annular guard, a main body, a motor, and a hydrodynamic fairing;

the impeller pump being connected adjacent to the first shaft end;

the handle being integrated into the elongated shaft, offset from the second shaft end;

the control input device being laterally mounted onto the handle;

the control input device being electronically connected to the microprocessor;

the microprocessor being electronically connected to the impeller pump;

the microprocessor and the portable power source being housed within the elongated shaft;

the portable power source being electrically connected to the impeller pump;

the swivel bracket being integrated into the elongated shaft, offset from the impeller pump;

a rotation axis of the impeller pump being positioned perpendicular to a longitudinal axis of the elongated shaft;

the microprocessor being electronically connected to the motor;

the motor being housed within the main body;

the impeller being torsionally connected to a rotor of the motor;

the impeller being positioned adjacent to the main body;

the annular guard being mounted adjacent to the main body;

the impeller being encircled by the annular guard; and the hydrodynamic fairing being connected adjacent to the main body, opposite the impeller.

12. The retrofittable watercraft propulsion device as claimed in claim 11 comprises:

a grip; and the grip being connected adjacent to the second shaft end.

13. The retrofittable watercraft propulsion device as claimed in claim 11 comprises:

the handle comprises a plurality of finger grooves;

the handle further comprises a first flange and a second flange;

the control input device comprises a variable speed trigger and a safety stop;

each the plurality of finger grooves being serially positioned along the longitudinal axis of the elongated shaft;

the variable speed trigger being mounted adjacent to the plurality of finger grooves;

the safety stop being mounted adjacent to the plurality of finger grooves, opposite the variable speed trigger;

the first flange and the second flange being laterally connected around the elongated shaft;

the first flange and the second flange being positioned opposite to each other across the plurality of finger grooves;

the first flange being positioned in between the plurality of finger grooves and the second shaft end; and the variable speed trigger and the safety stop being positioned adjacent to the first flange.

14. The retrofittable watercraft propulsion device as claimed in claim 11 comprises:

a battery chamber;

the battery chamber being integrated into the elongated shaft; and the portable power source being mounted within the battery chamber.

15. The retrofittable watercraft propulsion device as claimed in claim 14 comprises:

an auxiliary power port;

the auxiliary power port being integrated into the battery chamber; and the auxiliary power port being electrically connected to the impeller pump.

16. The retrofittable watercraft propulsion device as claimed in claim 11 comprises:

the swivel bracket comprises an offsetting arm and a connecting pin;

the offsetting arm being laterally connected to the elongated shaft, offset from the impeller pump;

the offsetting arm being positioned perpendicular to the elongated shaft;

the connecting pin being connected perpendicular to the offsetting arm; and the connecting pin and the elongated shaft being positioned opposite each other along the offsetting arm.

17. The retrofittable watercraft propulsion device as claimed in claim 11 comprises:

the elongated shaft further comprises a first telescoping tube, a second telescoping tube, and a locking mechanism;

the first telescoping tube being slidably engaged into the second telescoping tube; and the locking mechanism being operatively integrated into the slidable engagement between the first telescoping tube and the second telescoping tube, wherein the locking mechanism is used to fix the first telescoping tube and the second telescoping tube at a variety of offsetting distances.

* * * * *